US005105789A

United States Patent [19]

Aramaki et al.

[11] Patent Number: 5,105,789

[45] Date of Patent: Apr. 21, 1992

[54] APPARATUS FOR CHECKING FAILURE IN EVAPORATED FUEL PURGING UNIT

[75] Inventors: Takashi Aramaki; Chiaki Saito; Toshio Takahata; Hirofumi Yano, all of Kanagawa, Japan

[73] Assignee: Nissan Motor Company, Limited, Yokohama, Japan

[21] Appl. No.: 673,332

[22] Filed: Mar. 22, 1991

[30] Foreign Application Priority Data

Mar. 22, 1990 [JP] Japan ..... 2-72573

[51] Int. Cl.[5] ..... F02M 25/08

[52] U.S. Cl. ..... 123/520; 123/198 D

[58] Field of Search ..... 123/198 D, 518, 519, 123/520, 521, 494

[56] References Cited

U.S. PATENT DOCUMENTS

| | | | |
|---|---|---|---|
| 4,677,956 | 7/1987 | Hamborg | 123/520 |
| 4,741,318 | 5/1988 | Kortge | 123/520 |
| 4,763,634 | 8/1988 | Morozumi | 123/520 |
| 4,821,701 | 4/1989 | Nankee | 123/520 |
| 4,862,856 | 9/1989 | Yokoe | 123/520 |
| 4,865,000 | 9/1989 | Yatima | 123/520 |
| 4,867,126 | 9/1989 | Yonekawa | 123/198 D |
| 4,926,825 | 5/1990 | Ohtaka | 123/520 |
| 4,932,386 | 6/1990 | Uozami | 123/520 |
| 4,949,695 | 8/1990 | Uranishi | 123/198 D |
| 4,962,744 | 10/1990 | Uranishi | 123/198 D |

FOREIGN PATENT DOCUMENTS

| | | | |
|---|---|---|---|
| 0062955 | 4/1982 | Japan | 123/518 |
| 0190955 | 8/1989 | Japan | 123/519 |
| 0244134 | 9/1989 | Japan | 123/519 |
| 0108843 | 4/1990 | Japan | 123/519 |
| 0130255 | 5/1990 | Japan | 123/519 |

*Primary Examiner*—Carl Stuart Miller

*Attorney, Agent, or Firm*—Foley & Lardner

[57] ABSTRACT

A failure checking apparatus for use with an internal combustion engine associated with an evaporated fuel purging unit having a canister adapted to accumulate evaporated fuel from a fuel tank. Communication is provided between the canister and the engine to introduce the evaporated fuel from the canister to the engine. The communication is interrupted to permit the canister to accumulate evaporated fuel from the fuel tank when a parameter related to a rate of evaporated fuel produced in the fuel tank exceeds a predetermined value. The communication is introduced into the canister and resumed to permit evaporated fuel to be introduced from the canister to the engine a predetermined period of time after the communication is interrupted. An air/fuel ratio at which the engine is operating is sensed for detecting a first value representing the air/fuel ratio when the communication is held interrupted and a second value representing the air/fuel ratio after the communication is resumed. A failure signal is produced, based upon a difference between the first and second air/fuel ratio values, to indicate that a failure occurs in the evaporated fuel purging unit.

9 Claims, 3 Drawing Sheets

APPARATUS FOR CHECKING FAILURE IN EVAPORATED FUEL PURGING UNIT

BACKGROUND OF THE INVENTION

This invention relates to an apparatus for checking a failure in an evaporated fuel purging unit having a canister adapted to accumulate evaporated fuel from a fuel tank and introduce the evaporated fuel into the engine.

It has been proposed, for example, in Japanese Patent Publication No. 56-11067 to prevent leakage of evaporated fuel from a fuel tank to the exterior by employing an evaporated fuel purging unit of the type having a canister connected through a conduit to the fuel tank and also through a conduit to an engine induction passage. The canister contains adsorbent, such as activated charcoal, for adsorbing or accumulating fuel evaporated in the fuel tank. The accumulated fuel is introduced from the canister to the engine under a vacuum pressure in the induction passage.

When at least one of the conduits comes off or clogs, a great amount of evaporated fuel will flow to the exterior. However, the driver and/or passenger hardly notices such a failure in the evaporated fuel purging unit.

SUMMARY OF THE INVENTION

Therefore, it is a main object of the invention to provide a failure checking apparatus which can reliably check a failure in an evaporated fuel purging unit.

There is provided, in accordance with the invention, an apparatus for use with an internal combustion engine associated with an evaporated fuel purging unit having a canister adapted to accumulate evaporated fuel from a fuel tank and means for providing communication of the canister with the engine to introduce the evaporated fuel from the canister to the engine. The apparatus comprises first means sensitive to a parameter related to a rate of evaporated fuel produced in the fuel tank and introduced into the canister for producing a command signal when the sensed parameter exceeds a predetermined value, and second means responsive to the command signal for interrupting the communication between the canister and the engine to permit the canister to accumulate evaporated fuel from the fuel tank. The second means resumes the communication to permit evaporated fuel to be introduced from the canister to the engine a predetermined period of time after the communication is interrupted. The apparatus also comprises third means sensitive to an air/fuel ratio at which the engine is operating for detecting a first value representing the air/fuel ratio when the communication is held interrupted and a second value representing the air/fuel ratio after the communication is resumed, and fourth means for producing a failure signal indicative of a failure in the evaporated fuel purging unit based upon a difference between the first and second air/fuel ratio values.

In one aspect of the invention, the first means includes a temperature sensor sensitive to an ambient temperature, and means for producing the command signal when the sensed ambient temperature exceeds a predetermined value.

In another aspect of the invention, the first means includes a temperature sensor sensitive to a temperature of fuel in the fuel tank, and means for producing the command signal when the sensed fuel temperature exceeds a predetermined value.

In still another aspect of the invention, the first means includes a pressure sensor sensitive to a pressure in the fuel tank, and means for producing the command signal when the sensed pressure exceeds a predetermined value.

BRIEF DESCRIPTION OF THE DRAWINGS

The invention will be described in greater detail by reference to the following description taken in connection with the accompanying drawings, in which.

DETAILED DESCRIPTION OF THE INVENTION

Figure 1:
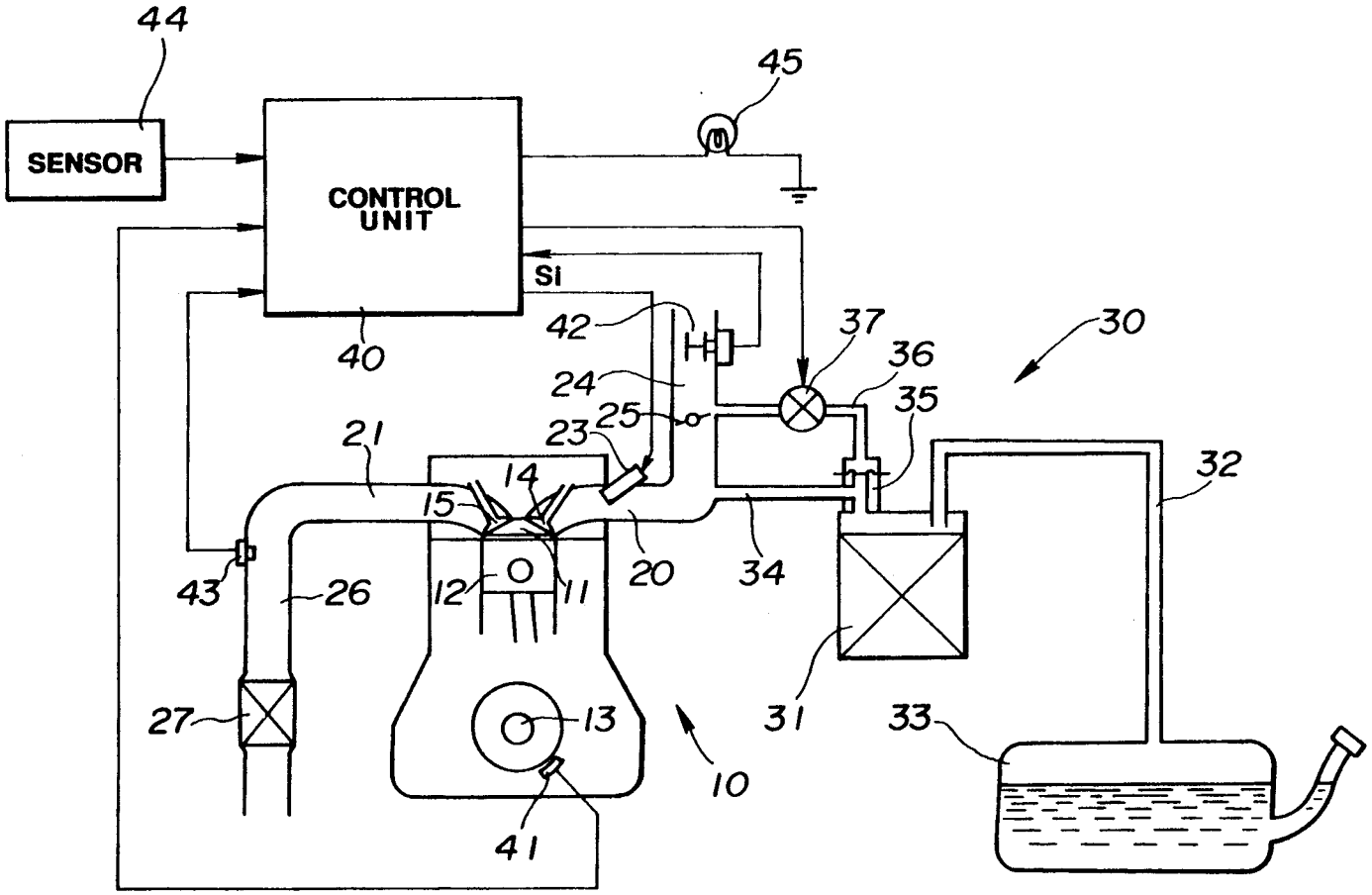
FIG. 1 is a schematic diagram of an internal combustion engine to which the invention is applicable.

With reference to the drawings, and in particular to FIG. 1, there is shown a schematic diagram of a failure checking apparatus embodying the invention. An internal combustion engine, generally designated by the numeral 10, for an automotive vehicle includes combustion chambers or cylinders, one of which is shown at 11. A piston 12 is mounted for reciprocal motion within the cylinder 11. A crankshaft 13 is supported for rotation within the engine 10 in response to reciprocation of the piston 12 within the cylinder 11.

An intake manifold 20 is connected with the cylinder 11 through an intake port with which an intake valve 14 is in cooperation for regulating the entry of combustion ingredients into the cylinder 11 from the intake manifold 20. A spark plug (not shown) is mounted in the top of the cylinder 11 for igniting the combustion ingredients within the cylinder 11 when the spark plug is energized by the presence of high voltage electrical energy. An exhaust manifold 21 is connected with the cylinder 11 through an exhaust port with which an exhaust valve 15 is in cooperation for regulating the exit of combustion products, exhaust gases, from the cylinder 11 into the exhaust manifold 21. The intake and exhaust valves are driven through a suitable linkage with the crankshaft.

A fuel injector 23 is mounted for injecting fuel into the intake manifold 20 toward the intake valve 14. The fuel injector 23 opens to inject fuel into the intake manifold 20 when it is energized by the presence of electrical signal Si. The length of the electrical pulse, that is, the pulse-width, applied to the fuel injector 23 determines the length of time the fuel injector 23 opens and, thus, determines the amount of fuel injected into the intake manifold 20.

Air to the engine 10 is supplied through an air cleaner (not shown) into an induction passage 24. The amount of air permitted to enter the combustion chamber 11 through the intake manifold 20 is controlled by a butterfly throttle valve 25 located within the induction passage 24. The throttle valve 25 is connected by a mechanical linkage to an accelerator pedal (not shown). The degree to which the accelerator pedal is depressed controls the degree of rotation of the throttle valve 25. The accelerator pedal is manually controlled by the operator of the engine control system. In the operation of the engine 10, the exhaust gases are discharged into the exhaust manifold 21 and hence to the atmosphere through an exhaust passage 26 having a catalytic converter 27 provided therein.

The engine 10 is associated with an evaporated fuel purging apparatus, generally designated by the numeral 30, which includes a canister 31 employing an adsorbent, such as activated charcoal, for accumulating or adsorbing evaporated fuel introduced therein from a fuel tank 33. For this purpose, the canister 31 has an inlet port connected through an evaporated fuel passage 32 to the upper space of the fuel tank 33. The canister 31 also has an outlet port connected through a purge passage 34 to the induction passage 24 at a position downstream of the throttle valve 25. A diaphragm type control valve 35 is provided in the purge passage 34 for opening and closing the purge passage 34. The control valve 35 operates on a vacuum introduced thereto through a vacuum passage 36 which opens into the induction passage 24 at a position somewhat upstream of the fully-closed position of the throttle valve 25. The control valve 35 closes the purge passage 34 to interrupt communication between the canister 31 and the induction passage 24 only when the engine is idling or operating at low load conditions. A solenoid valve 37 is provided in the vacuum passage 36 for opening and closing the vacuum passage 36 and will be described later in greater detail.

The amount of fuel metered to the engine, being determined by the width Ti of the electrical pulses Si applied to the fuel injector 23, is repetitively determined from calculations performed by a control unit 40, these calculations being based upon various conditions of the engine that are sensed during its operation. These sensed conditions include engine coolant temperature, exhaust oxygen content, engine speed, and intake air flow. Thus, an engine coolant temperature sensor (not shown), a crankshaft position sensor 41, a flow meter 42, and an air/fuel ratio sensor 43 are connected to the control unit 40.

The engine coolant temperature sensor is mounted in the engine cooling system and comprises a thermistor connected to an electrical circuit capable of producing a coolant temperature signal in the form of a DC voltage having a variable level proportional to coolant temperature. The crankshaft position sensor 41 is provided for producing a series of crankshaft position electrical pulses of a repetitive rate directly proportional to engine speed. The flow meter 42 is located in the induction passage 24 at a position upstream of the throttle valve 25 to sense the air flow through the induction passage 24 and it produces an intake airflow signal proportional thereto.

The air/fuel ratio sensor 43 is provided to probe the exhaust gases discharged from the cylinders 11 and it is effective to produce a signal indicative of the air/fuel ratio at which the engine is operating. This singal is a voltage signal corresponding to the residual oxygen content of the exhaust gases discharged from the engine. The output of the air/fuel ratio sensor 43 is provided to a comparator switch whose output is a high or low value representing the sense of deviation of the air/fuel ratio of the mixture supplied to the engine from the stoichiometric value. The output of the comparator switch is processed by a pseudo proportional plus integral control to obtain a correction factor ALPHA used for providing a closed loop air/fuel ratio control in such a manner as to shift the air/fuel ratio toward the rich side when the correction factor ALPHA is greater than 1 or toward the lean side when the correction factor ALPHA is less than 1. The correction factor ALPHA is useful to indicate the sense of deviation of the air/fuel ratio relative to the stoichiometric value when no closed loop air/fuel ratio control is performed.

The control unit 40 also checks a failure in the evaporated fuel purging apparatus 30. For this purpose, a sensor 44 is connected to the control unit 40. The sensor 44 senses a parameter which may be an ambient temperature, a temperature of fuel in the fuel tank 33, a pressure in the fuel tank 33, or the like related to a rate of evaporated fuel produced in the fuel tank 33 and introduced to the canister 31. For convenience of description, the sensor 44 is an ambient temperature sensor positioned to sense an ambient temperature. The ambient temperature sensor 44 produces an electric signal indicative of the sensed ambient temperature to the control unit 40.

When the sensed ambient temperature is greater than a predetermined value indicating a sufficient amount of evaporated fuel produced in the fuel tank 33, the control unit 40 produces a command signal to cause the solenoid valve 37 to interrupt the communication between the canister 31 and the engine 10 so as to permit the canister 31 to accumulate evaporated fuel from the fuel tank 33. After a predetermined time is elapsed so that a sufficient amount of evaporated fuel is accumulated in the canister 31, the control unit 40 produces a command signal to cause the solenoid valve 37 to resume the communication between the canister 31 and the engine so as to permit evaporated fuel to be introduced from the canister 31 to the engine 10. The control unit 40 calculates a first average value for the correction factor ALPHA when the communication is held interrupted and a second average value for the correction factor ALPHA a predetermined time after the communication is resumed. The control unit 40 energizes a lamp 45 to indicate a failure in the evaporated fuel purging apparatus 30 when a difference between the first and second average values is less than a predetermined value.

The control unit 40 comprises a digital computer which includes a central processing unit (CPU), a read only memory (ROM), a random access memory (RAM), and an input/output control unit (I/O). The central processing unit communicates with the rest of the computer via data bus. The input/output control unit includes an analog-to-digital converter which receives analog signals from the flow meter and other sensors and converts them into digital form for application to the central processing unit which selects the input channel to be converted. The read only memory contains programs for operating the central processing unit and further contains appropriate data in look-up tables used in calculating appropriate values for fuel delivery requirement. The central processing unit is programmed in a known manner to interpolate between the data at different entry points.

The central processing unit calculates the fuel delivery requirement in the form of fuel-injection pulse-width. For this purpose, a basic value Tp for fuel-injection pulse-width is calculated as $$Tp = k \times Q/N$$

where k is a constant, Q is the intake air flow rate and N is the engine speed. The calculated fuel-injection pulse-width basic value Tp is then corrected for various engine operating parameters. The corrected fuel-injection pulse-width value Ti is given as $$Ti = Tp \times COEF \times ALPHA + Ts$$

where ALPHA is a correction factor related to the oxygen content of the exhaust gases for providing a closed loop air/fuel ratio control, Ts is a correction factor related to the voltage of the car battery, and COEF is a correction factor given as $$COEF = 1 + KTW + KMR + KAS + KAI + KFUEL$$

where KTW is a correction factor decreasing as the engine coolant temperature increases, and KMR is a correction factor for providing fuel enrichment control under high engine load conditions. The correction factor KMR is greater at a heavier engine load or at a higher engine speed. KAS is a correction factor for providing fuel enrichment control when the engine is cranking, KAI is a correction factor for providing fuel enrichment control when the engine is idling, and KFUEL is a correction factor for providing fuel enrichment control during acceleration.

Control words specifying desired fuel delivery requirements are periodically transferred by the central processing unit to the fuel-injection circuit included in the input/output control circuit. The fuel injection control circuit converts the received control word into a fuel injection pulse signal Si for application to a power transistor which connects the fuel injector 23 to the car battery for a time period calculated by the digital computer.

Figure 2:
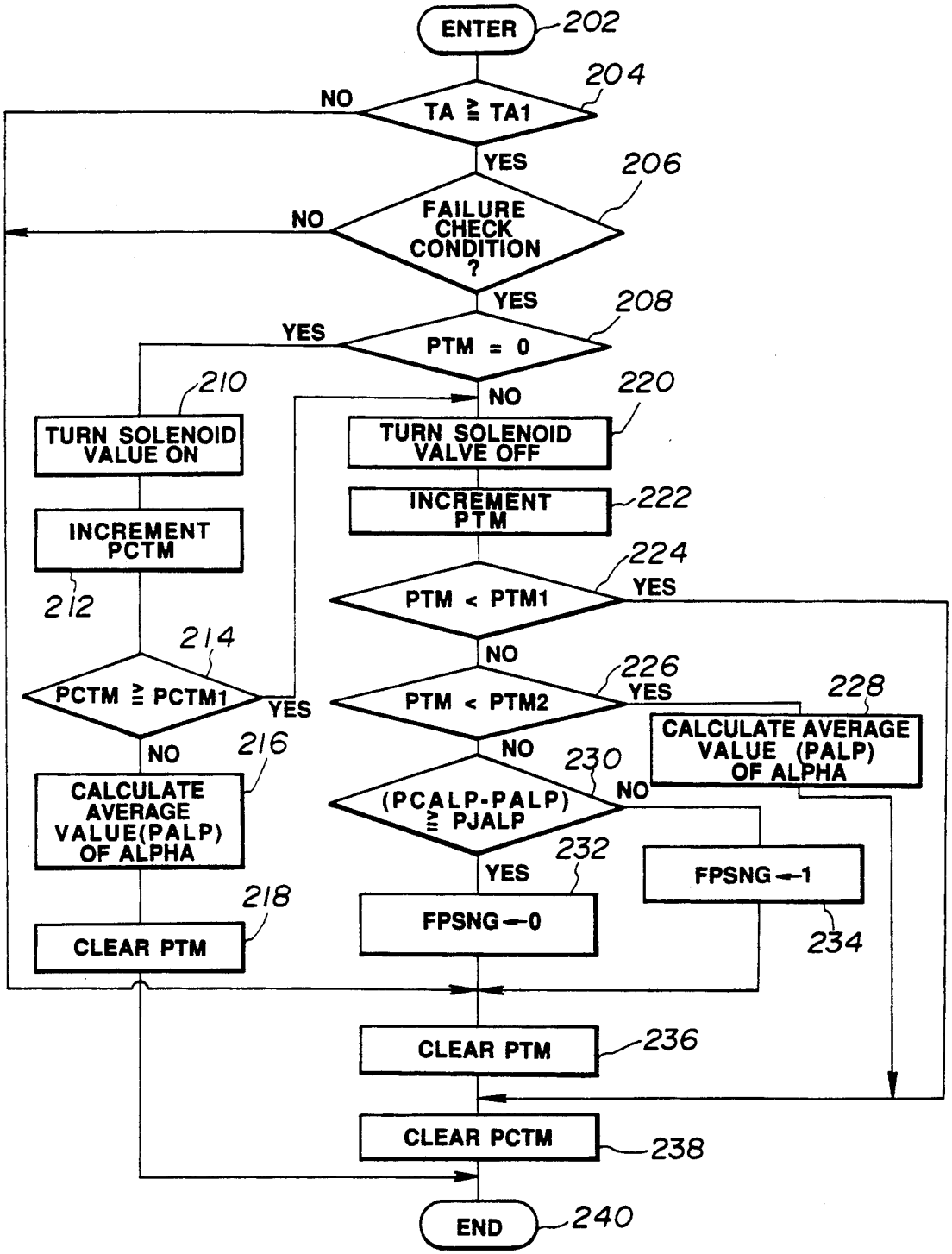
FIG. 2 is a flow diagram illustrating the programming of the digital computer as it is used to check a failure in an evaporated fuel purging unit.

FIG. 2 is a flow diagram illustrating the programming of the digital computer as it is used to check a failure in the evaporated fuel purging apparatus.

The computer program is entered at the point 202, for example, at uniform intervals of time. At the point 204 in the program, a determination is made as to whether or not the sensed ambient temperature TA is equal to or greater than a predetermined value TA1, for example, 25° C. If the answer to this question is "yes", then the program proceeds to the point 206. Otherwise, it means the danger of an erroneous failure check and the program proceeds to the point 236.

At the point 206 in the program, a determination is made as to whether or not the engine is operating at conditions suitable for a failure check. When the engine is operating at low-speed, low-load conditions, the amount of evaporated fuel introduced into the canister 31 is too small to provide a good failure check. The failure check is not suitable at very high-speed, high-load conditions where the amount of air introduced to the engine is so great that the purged gas has almost no effect on the air/fuel ratio and also during an engine transient condition, such as acceleration, where no correct air/fuel ratio change is measured. This determination may be made upon vehicle speed or engine load (basic pulse width Tp). If the answer to this question is "yes", then the program proceeds to the point 208. Otherwise, the program proceeds to the point 236.

At the point 208 in the program, a determination is made as to whether or not the count PTM of a second counter is equal to zero. If the answer to this question is "yes", then the program proceeds to the point 210. Otherwise, the program proceeds to the point 220.

At the point 210 in the program, a command is produced to close the solenoid valve 37, causing the control valve 35 to close the purge passage 34. At the point 212 in the program, the count PCTM of a first counter is incremented. The count PCTM of the first counter indicates the time interval during which the communication between the canister 31 and the engine 10 is interrupted to accumulate evaporated fuel in the canister 31. Following this, the program proceeds to a determination step at the point 214. This determination is as to whether or not the count PCTM of the first counter is equal to or greater than a predetermined value, for example 15 minutes. If the answer to this question is "yes", then the program proceeds to the point 220. Otherwise, the program proceeds to the point 216 where the average value PCALP of the correction factor ALPHA is calculated. Upon completion of this calculation, the program proceeds to the point 218 where the count PTM of the second counter is cleared to zero. Following this, the program proceeds to the end point 240.

At the point 220 in the program, a command is produced to open the solenoid valve 37. This permits the control valve 35 to open the purge passage 34 so as to resume the communication between the canister 31 and the engine 10. This permits evaporated fuel to be introduced from the canister 31 into the induction passage 24 so as to cause a temporary air/fuel ratio enrichment. The program then proceeds to the point 222 where the count PTM of the second counter is incremented. This count PTM indicates the time lapse after the communication between the cansister 31 and the engine 10 is resumed.

At the point 224 in the program, a determination is made as to whether or not the count PTM of the second counter is less than a first predetermined value PTM1, for example, 10 seconds. The first predetermined value PTM1 is determined based upon the time required for the temporary air/fuel ratio enrichment to have an effect on the air/fuel ratio sensor 43. If the answer to this question is "yes", then it means that the temporary air/fuel ratio enrichment has no effect on the output of the air/fuel ratio sensor 43 and the program proceeds to the point 238 where the count PCTM of the first counter is cleared to zero. Otherwise, the program proceeds to another determination step at the point 226. This determination is as to whether or not the count PTM of the second counter is less than a second predetermined value PTM2, for example, 20 seconds. If the answer to this question is "yes", then it means that $PTM1 \leqq PTM > PTM2$ and the program proceeds to the point 228 where the average value PALP of the correction factor ALPHA is calculated. Upon completion of this calculation, the program proceeds to the point 238.

If the count PTM of the second counter exceeds the second predetermined value PTM2, then the program proceeds from the point 226 to another determination step at the point 230. This determination is as to whether or not a difference (PCALP−PALP) of the average value PALP calculated at the point 228 from the average value PCALP calculated at the point 216 is equal to or greater than a predetermined value PJALP. If the answer to this question is "yes", then it means that the air/fuel ratio shifts to a great extent toward the rich side and the program proceeds to the point 232 where a flag FPSNG is cleared to indicate that the purging apparatus is in order and the program then proceeds to the point 236. Otherwise, the program proceeds to the point 234 where the flag FPSNG is set to indicate that a failure occurs in the purging apparatus and the program then proceeds to the point 236. When the flag FPSNG is set, the central processing unit produces a command causing the alarm lamp 45 to go on so as to provide a visual indication to the driver and/or passenger that a failure occurs in the evaporated fuel purging apparatus 30.

At the point 236 in the program, the count PTM of the second counter is cleared. Following this, the program proceeds to the point 238 where the count PCTM of the first counter is cleared and then to the end point 240.

The operation will be described in connection with FIG. 3. The solenoid valve 37 is held closed (turned on) for a predetermined time interval, as shown in FIG. 3A, to interrupt the communication between the canister 31 and the induction passage 24. During the time interval, the amount of evaporated fuel accumulated or adsorbed in the canister 31 increases gradually, as shown in FIG. 3B, where the one-dotted line indicates a value required for a failure check. If the ambient temperature AT is less than the predetermined value AT1, the amount of evaporated fuel accumulated in the canister 31 cannot exceed the required value, as indicated by the broken curve of FIG. 3B. If the ambient temperature AT exceeds the predetermined value AT1, the amount of evaporated fuel accumulated in the canister 31 will exceed the required value, as indicated by the solid curve of FIG. 3B.

When the solenoid valve 37 is turned off to resume the communication between the canister 31 and the induction passage 24, the evaporated fuel is discharged from the canister 31 to the induction passage 24 so as to provide a temporary air/fuel ratio enrichment. As a result, the amount of the evaporated fuel accumulated in the canister 31 decreases gradually, as shown in FIG. 3B. This will cause the correction factor ALPHA to decrease to a great extent, as shown in FIG. 3C, if the evaporated fuel purging apparatus is in order. If a failure occurs in the evaporated fuel purging apparatus, almost no change will occur in the correction factor ALPHA, as shown in FIG. 3D.

Figures 3A, 3B, 3C, 3D, 3E:
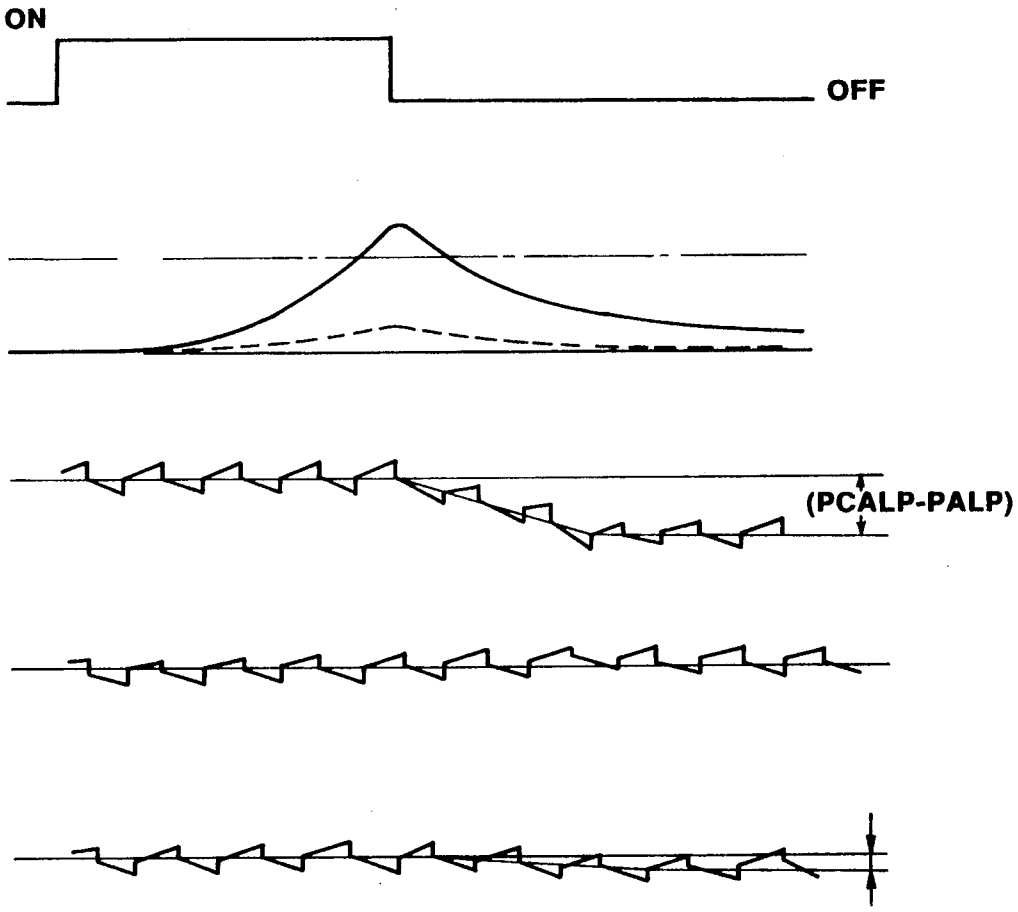
FIG. 3 contains five waveforms 3A to 3E used in explaining the operation of the failure checking apparatus of the invention.

At low ambient temperatures, the effect on the correction factor change is small, as shown in FIG. 3E, even though the evaporated fuel purging apparatus 30 is in order since the amount of the evaporated fuel accumulated in the canister 31 is small, as indicated by the broken line of FIG. 3B. In order to avoid an erroneous failure check, no failure check is performed when the ambient temperature AT is less than a predetermined value AT1.

What is claimed is:

1. An apparatus for use with an internal combustion engine associated with an evaporated fuel purging unit having a canister adapted to accumulate evaporated fuel from a fuel tank and means for providing communication of the canister with the engine to introduce the evaporated fuel from the canister to the engine, comprising:

first means sensitive to a parameter related to a rate of evaporated fuel produced in the fuel tank and introduced into the canister for producing a command signal when the sensed parameter exceeds a predetermined value;

second means responsive to the command signal for interrupting the communication between the canister and the engine to permit the canister to accumulate evaporated fuel from the fuel tank, the second means resuming the communication to permit evaporated fuel to be introduced from the canister to the engine for a predetermined period of time after the communication is interrupted;

third means sensitive to an air/fuel ratio at which the engine is operating for detecting a first value representing the air/fuel ratio when the communication is held interrupted and a second value representing the air/fuel ratio after the communication is resumed; and fourth means for producing a failure signal indicative of a failure in the evaporated fuel purging unit based upon a difference between the first and second air/fuel ratio values.

2. The apparatus as claimed in claim 1, the fourth means includes means for calculating a difference between the first and second values, and means for producing the failure signal when the calculated difference exceeds a predetermined value.

3. The apparatus as claimed in claim 1, wherein the third means includes means for calculating the second value a predetermined time after the communication is resumed.

4. The apparatus as claimed in claim 1, wherein the third means includes sensor means for sensing an oxygen content of exhaust gases discharged from the engine, means for calculating a correction factor related to the sensed oxygen content for use in providing a closed loop air/fuel ratio control, means for calculating a first average value of the correction factor when the communication is held interrupted and a second average value of the correction factor after the communication is resumed, and wherein the fourth means includes means for producing the failure signal when a difference between the first and second average values exceeds a predetermined value.

5. The apparatus as claimed in claim 4, wherein the second average value is calculated, for a predetermined period of time, a predetermined time after the communication is resumed.

6. The apparatus as claimed in claim 1, wherein the first means includes a sensor sensitive to an ambient temperature, and means for producing the command signal when the sensed ambient temperature exceeds a predetermined value.

7. The apparatus as claimed in claim 1, wherein the first means includes a sensor sensitive to a temperature of fuel in the fuel tank, and means for producing the command signal when the sensed fuel temperature exceeds a predetermined value.

8. The apparatus as claimed in claim 1, wherein the first means includes a sensor sensitive to a pressure in the fuel tank, and means for producing the command signal when the sensed pressure exceeds a predetermined value.

9. The apparatus as claimed in claim 1, wherein the canister includes an adsorbent for adsorbing evaporated fuel introduced from the fuel tank.

* * * * *